US005099862A

United States Patent [19]

White et al.

[11] Patent Number: 5,099,862

[45] Date of Patent: Mar. 31, 1992

[54] TOBACCO EXTRACTION PROCESS

[75] Inventors: Jackie L. White, Pfafftown; Thomas A. Perfetti, Winston-Salem; Dennis L. Potter, Kernersville, all of N.C.

[73] Assignee: R. J. Reynolds Tobacco Company, Winston-Salem, N.C.

[21] Appl. No.: 505,327

[22] Filed: Apr. 5, 1990

[51] Int. Cl.[5] ..... A24B 15/20; A24B 15/24; A24B 15/26

[52] U.S. Cl. ..... 131/297; 131/298; 131/308

[58] Field of Search ..... 131/297, 290, 298, 308

[56] References Cited

U.S. PATENT DOCUMENTS 3,095,882 7/1963 Hind et al. .
3,136,321 9,1964 Davis .
3,147,199 9/1964 Neel ..... 131/297
3,316,919 5/1967 Green et al. .
3,424,171 1/1969 Rooker .
4,135,521 1/1979 Malan et al. .
4,308,877 1/1982 Mattina .
4,421,126 12/1983 Gellatly .
4,476,881 10/1984 Gravely et al. .
4,506,682 3/1985 Muller .
4,537,204 8/1985 Gaisch et al. .
4,572,219 2/1986 Gaisch et al. .
4,662,982 11/1986 Gaisch et al. .
4,685,478 8/1987 Malik et al. .
4,709,710 12/1987 Gaisch et al. .
4,756,318 6/1988 Clearman et al. .
4,895,175 1/1990 Baskevitch et al. .

*Primary Examiner*—V. Millin

[57] ABSTRACT

Tobacco-derived components of a tobacco extract are provided by fermenting the tobacco extract within a fermentation bath. The extract may be subjected to heat treatment in a pressure controlled environment prior to and/or after fermenting.

The fermented tobacco extract is then distilled at a temperatrue to provide a distillate which includes tobacco-derived components of the tobacco extract. If the extract has not previously been subjected to heat treatment, the distillate can be subjected to heat treatment in a pressure controlled environment.

40 Claims, 2 Drawing Sheets

TOBACCO EXTRACTION PROCESS

BACKGROUND OF THE INVENTION

The present invention relates to extraction of tobacco components, and in particular to processes for providing tobacco-derived components of that tobacco extract.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desireable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al.; 4,756,318 to Clearman et al.; and 4,793,365 to Sensabaugh, Jr. et al.; and European Patent Publication Nos. 212,234 and 277,519 propose cigarettes and pipes which comprise a fuel element, an aerosol generating means physically separate from the fuel element, and a separate mouth-end piece. Such types of smoking articles provide natural tobacco flavors to the smoker thereof by heating, rather than burning, tobacco in various forms.

Natural tobacco flavors are important components of smoking articles and provide adequate tobacco taste and aroma to the smoking article. Thus improved processes for providing natural tobacco flavor and aromatic substances and flavorable and aromatic forms of tobacco are desirable. As a result, there has been interest in extracting particular components from tobacco. For example, various processes for producing and using tobacco extracts, aroma oils and concentrates are proposed in U.S. Pat. Nos. 3,136,321 to Davis; 3,316,919 to Green; 3,424,171 to Rooker; 4,421,126 to Gellatly and 4,506,682 to Mueller and European Patent No. 338,831 to Clapp et. al. There has also been interest in fermenting tobacco. For example, various processes utilizing fermentation techniques have been suggested in U.S. Pat. Nos. 4,895,175 to Baskevitch et al; 4,622,982 to Gaisch et al; 4,476,881 to Gravely et al; and 4,308,877 to Mattina.

It would be highly desirable to provide tobacco-derived components (e.g., the flavor and aromatic components) of a tobacco extract, and particularly to provide those tobacco-derived components having an alcohol content greater than about 15 percent by weight and preferably greater than about 50 percent by weight.

SUMMARY OF THE INVENTION

The present invention relates to a process for providing tobacco-derived components of tobacco extract for use with other forms of tobacco for various types of cigarettes and other smoking articles.

In particular, a tobacco material is extracted with an extraction solvent to provide a tobacco extract. The tobacco extract is fermented within a fermentation bath preferably including at least one strain of yeast. The tobacco extract/yeast mixture is distilled to provide a distillate including tobacco-derived components including flavor and aromatic components. Preferably the distillate is distilled at a temperature between about 75° C. to about 85° C. and at atmospheric pressure a number of times (i.e. re-distilled) until the distillate has an alcohol content greater than about 15 percent by weight and preferably greater than about 50 percent by weight.

If desired, the tobacco extract can be subjected to heat treatment in a pressure controlled environment prior to the time of fermenting the tobacco extract. The pressure controlled environment is provided by a pressure chamber or vessel which provides containment of the tobacco extract such that the volatile flavor and aromatic components thereof are not lost during the heat treatment step. The vessel provides for heat treatment at a temperature significantly above 100° C. and at a typical pressure range of from about 10 psig to about 1,000 psig, normally from about 20 psig to about 500 psig.

In another embodiment, the fermented tobacco extract/yeast mixture is subjected to heat treatment in the pressure controlled environment as described above, but after fermentation and before distillation.

In another embodiment, the tobacco extract is fermented and distilled to provide a distillate as described above, and the distillate is subjected to heat treatment in a pressure-controlled environment.

In the embodiments wherein the tobacco extract, the tobacco extract/yeast mixture or the distillate are subjected to heat treatment, additives such as at least one sugar and/or at least one amino acid can be incorporated into the tobacco extract prior to the heat treatment. These additives facilitate the Maillard reaction of certain components of the tobacco extract.

The tobacco-derived components of the tobacco provided, by any of these embodiments are useful in smoking products. For example, such flavor and aromatic tobacco components are useful on tobacco as casing or top dressing components for tobacco laminae and cut filler, as well as for other smokable materials. Alternatively, such tobacco components are useful in those types of smoking articles described in U.S. Pat. Nos. 4,708,151 to Shelar; 4,714,082 to Banerjee et al; 4,756,318 to Clearman et al; and 4,793,365 to Sensabaugh et al; as well as European Patent Publication Nos. 212,234 and 277,519.

The flavor and aromatic components also are useful as cigarette filter additives. For example, the flavor and aromatic components can be incorporated into low density polyethylene and formed into strands, and then incorporated into cigarette filters as described in U.S. Pat. Nos. 4,281,671 to Bynre et al and 4,862,905 to Green, Jr., et al. The tobacco-derived components also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

DETAILED DESCRIPTION OF THE PREFERRED EMBODIMENTS

Figure 1:
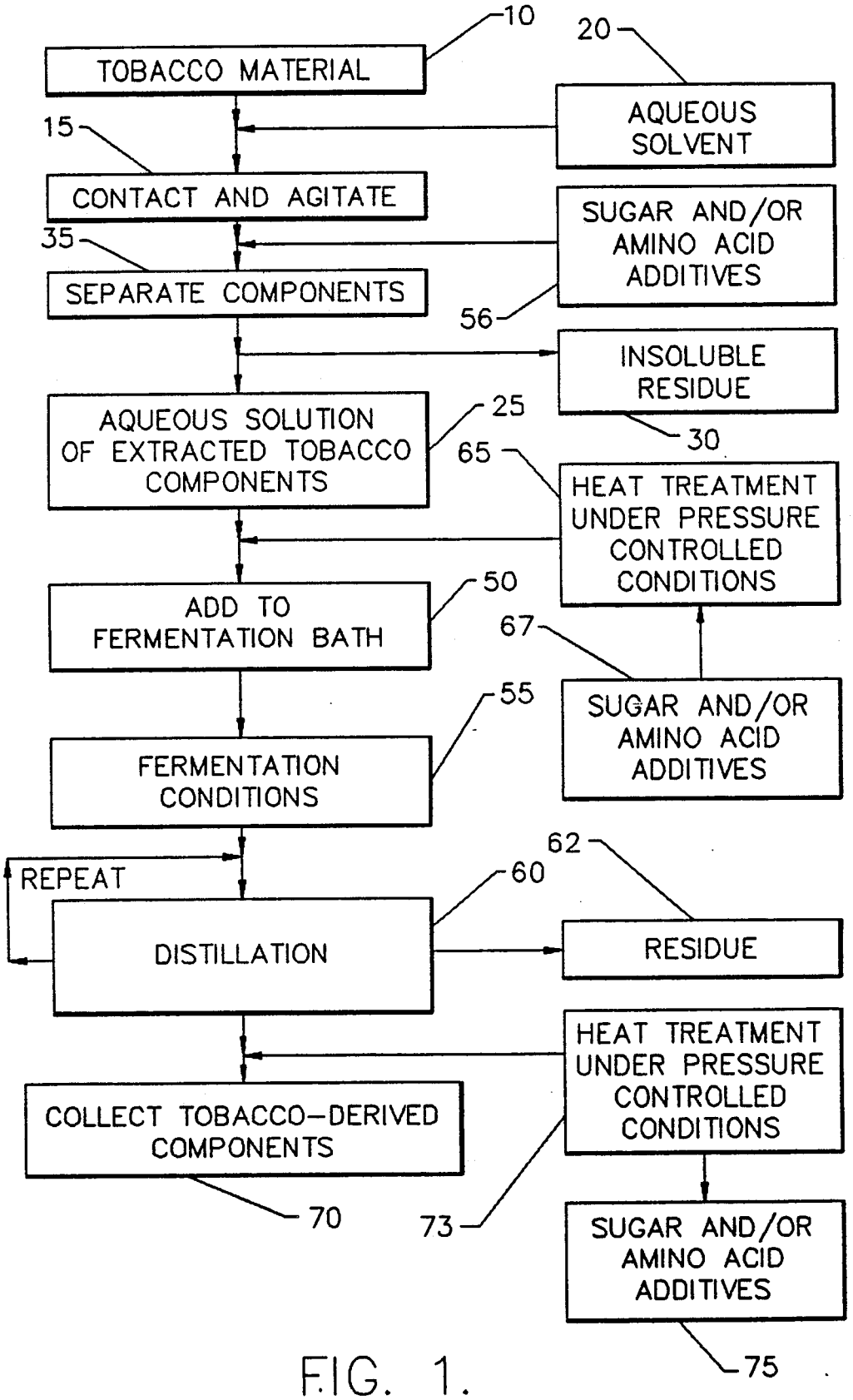
FIG. 1 is a schematic diagram of process steps representative of one embodiment of the present invention.

Referring to FIG. 1, tobacco material 10 is contacted 15 with an aqueous extraction solvent 20 preferably with agitation. As such, various soluble components are extracted from the tobacco material 10 yielding an aqueous tobacco extract 25 and a water insoluble tobacco residue 30. The aqueous tobacco extract is separated 35 from the insoluble residue using centrifugation techniques, or the like. The extracted tobacco components are separated from the solvent by spray drying techniques or the like. The extract is contacted 50 with a fermentation bath preferably including at least one strain of yeast, and fermented 55 within the fermentation bath. Optionally, additives 56 such as flavors or at least one sugar and/or at least one amino acid can be incorporated into the extract prior to fermentation. The fermented extract mixture, namely the extract mixed with the yeast within the fermentation bath, is then distilled 60 at a temperature between about 75° C. to about 85° C. and at atmospheric pressure utilizing distillation techniques commonly known in the art. The distillation provides a distillate including tobacco-derived components of the tobacco extract 25 which are separated from a residue 62 of the fermentation bath. Distillation of the distillate is repeated until the distillate has an alcohol content of at least 15 percent weight and preferably 50 percent by weight.

Prior to fermentation the extract/yeast mixture can be subjected 65 to a heat treatment in a pressure controlled environment. Additives 67 such as at least one sugar and/or at least one amino acid optionally can be incorporated into the tobacco extract prior to the heat treatment, particularly when not added earlier. The tobacco-derived components are then collected 70 for later use in the manufacture of cigarettes and other smoking articles.

In another embodiment, if the tobacco extract is not subjected to heat treatment prior to fermentation, the distillate can optionally be heated treated 73 with or without the addition of additives 75.

Figure 2:
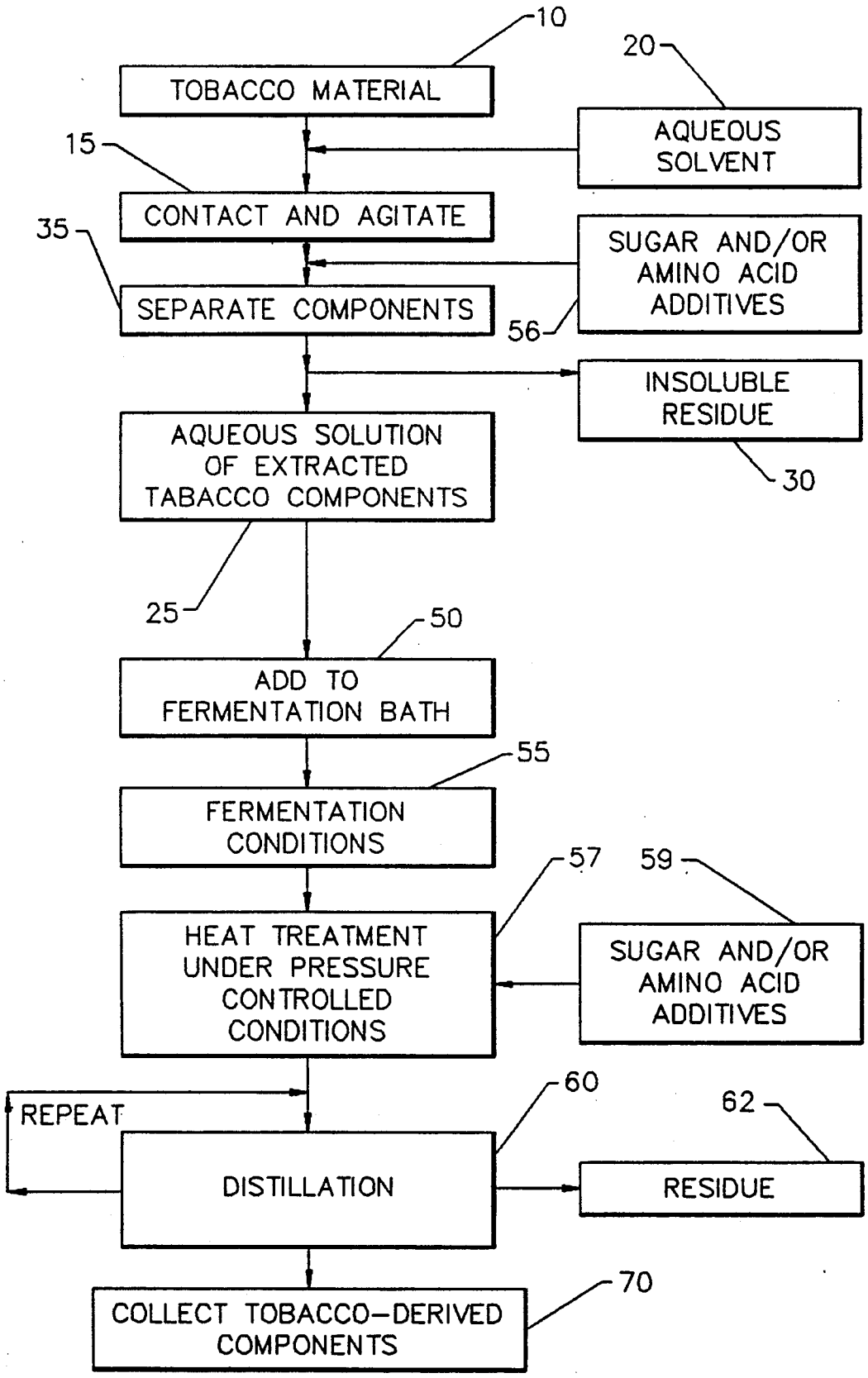
FIG. 2 is a schematic diagram of process steps representative of another embodiment of the present invention.

Referring to FIG. 2, another embodiment of the present invention is illustrated with like numerals indicating aspects common to those in FIG. 1. The tobacco material 10 is contacted 15 with an aqueous extraction solvent 20 to extract various soluble components yielding an aqueous tobacco extract 25 and a water insoluble tobacco residue 30. The aqueous tobacco extract is separated 35 from the insoluble residue using centrifugation techniques, or the like. The extracted tobacco components are separated from the solvent by spray drying techniques, or the like. The extract is contacted 50 with the fermentation bath preferably including at least one strain of yeast, and fermented 55 within the fermentation bath. Optionally, sugar and/or amino acid additives 56 can be incorporated into the extract prior to fermentation. The fermented extract 25 is then subjected 57 to heat treatment in the pressure controlled environment with the optional incorporation of sugar and/or amino acid additives 59 to the extract prior to heat treatment. The heat treated fermented extract mixture is distilled 60 at a temperature between about 75° C. to about 85° C. and at atmospheric pressure to provide a distillate including tobacco-derived components of the tobacco extract 25 which are separated from a residue 62. The distillate is distilled until the distillate has an alcohol content of at least 15 percent by weight and preferably about 50 percent by weight and the tobacco-derived components are collected 70.

The tobacco materials useful herein can vary. Tobacco materials which are used of a form such that under extraction conditions, a portion thereof is soluble in (i.e., extracted by) an extraction solvent; and a portion thereof is insoluble in (i.e., not extracted by) that extraction solvent. Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

A tobacco extract can be provided in a number of ways. In particular, the tobacco material is subjected to extraction conditions with a suitable solvent to extract a sufficient amount of the desired components from the tobacco material. The manner in which the tobacco material is extracted, and the type of solvent employed, can vary. For example, the tobacco material can be extracted using organic solvents (e.g., hexane, methanol or ethanol), halocarbons and halogenated hydrocarbons, supercritical fluids (e.g., supercritical carbon dioxide and the like. Preferably, the tobacco extract is provided by extracting the tobacco material using a liquid having an aqueous character. Such a liquid consists primarily of water, normally greater than about 90 weight percent water, and can be essentially pure water in certain circumstances. For example, a solvent having a aqueous character can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith. Other methods for extracting components from tobacco materials, and isolating tobacco extracts will be apparent to the skilled artisan.

The tobacco extract can have various forms. For example, it is desirable to subject an aqueous extract to a spray drying, freeze drying, belt drying, flash drying, or other suitable solvent removal process, to provide a tobacco extract having a low moisture content. As such, tobacco extracts can have the form of a paste, a viscous liquid, a powder, a glandular solid, a gel, or the like. Tobacco extracts can be processed as described in European Patent Application Nos. 326,370 and 338,831. Typically, tobacco extracts are provided in the form of spray dried extracts, freeze dried extracts, tobacco essences, or the like.

For purposes of this invention, spray drying is a one-step continuous process for removing a liquid from a solution and producing a dried particulate form of the extracted components within the solution by spraying a feed of the solution into a hot drying medium. Representative spray drying processes are described in U.S. Pat. No. 3,398,754 to Tughan and European Patent Application No. 326,370. For purposes of this invention, freeze drying is an indirect, batch or continuous process for removing the liquid from a solution and producing a dried form of the extracted components by freezing the solution and drying the solution in a frozen state through sublimination under high vacuum. A representative freeze drying process is described in U.S. Pat. No. 3,316,919 to Green. Methods and conditions for providing extracted materials in a solid form (e.g., as a powder) will be apparent to the skilled artisan.

The extracted tobacco components can be provided at a predetermined solvent level (e.g., in a predetermined high moisture form) by evaporating the solvent from the mixture of solvent and extract. Vacuum distillation and film evaporation techniques are particularly preferred.

The tobacco extract can also be contacted with an aqueous liquid such as water in order to provide a moist extract. By "moist extract", it is intended to be meant that the amount of aqueous liquid to extract is preferably greater then about 4:1 by dry weight percent, preferably greater than about 5:1 and often about 10:1. It is noted that if solvent removal is not performed, certain tobacco extracts may have a significant moisture content, and do not require further addition of aqueous liquid thereto. The manner of contacting a low moisture content tobacco extract with the aqueous liquid can vary and is not particularly critical. Typically, the extract and liquid are mixed using stirring or agitation, and often employing gentle heating.

The tobacco extract, preferably a moist tobacco extract, is fermented in a fermentation bath under fermentation conditions. The basic reaction unusually involves the decomposition of sugars and starches to an alcohol (i.e., ethanol) and carbon dioxide. The reaction is induced by a living organism or enzyme, specifically bacteria or microorganisms occurring in one-celled plants (i.e., yeast, mold or fungi). Preferably, the tobacco extract is fermented in a fermentation bath including at least one strain of yeast. Preferred yeasts include strains of Candida (e.g., *Candida pseudotropicalis* and *Candida utilis*), strains of Kluyveromyces (e.g., *Kluyveromyces fragilis*), and strains of Saccharomyces (e.g., *Saccharomyces distaticus* and *Saccharomyces cerevisiae* sometimes referred to as "brewers yeast"). It is to be noted that most commercially available yeasts such as Geordie yeast, Montrachet yeast, Laaglander Irish Ale yeast, Fleishmann's yeast, Ale Beer yeast, etc. are mixtures of various yeast strains. If desired, the yeast can be employed in combination with various malts such as Geordie malt, Laaglander Irish Ale malt, etc.

Typically, the tobacco extract is fermented at room temperature over a period of at least two days and up to about fifteen days. The resulting tobacco extract/yeast mixture after fermentation typically has an alcohol content of at least 10 percent by weight and preferably at least 25 percent by weight, as measured by a commercially available vinometer.

The fermented tobacco extract/yeast mixture is distilled at temperature sufficient to distill the alcohol-containing tobacco-derived components of the extract. Typically, such distillation involves exposing the tobacco composition to a temperature between about 75° C. to about 85° C. and at atmospheric pressure. However, it is desirable to subject the tobacco extract/yeast mixture to a temperature below about 250° C., more desirably below 100° C., in order to avoid a undesirable loss of volatile flavor components which are deleterious to the overall taste characteristics of the tobacco extract if lost.

Preferably distillation apparatus known to those skilled in the art is used. The tobacco extract/yeast mixture is placed in a round bottom flask equipped with a heating mantle. Heat is applied to distill off the volatile flavor and aromatic components of the tobacco extract/yeast mixture leaving a residue in the flask. The resulting distillate, including the tobacco-derived components, is condensed by a condenser cooled by an ice water bath. The residue of the fermentation bath is discarded whereas the distillate can be distilled once again. Preferably distillation of the distillate is continued (i.e., four or five times) until the distillate has an alcohol content of at least 15 percent by weight and preferably at least 50 percent by weight. It is recognized that the distillation can be done at lower temperatures by employing vacuum distillation apparatus know to those skilled in the art. Other techniques also can be employed, and it is within the skill of the art to use these other techniques so long as the loss of volatile components of the tobacco extract is minimized.

Optionally, heat treatment in a pressure controlled environment can be done at any of three times in the process of the present invention i.e. (i) before fermentation of the tobacco extract, (ii) after fermentation and before distillation of the tobacco extract/yeast mixture, or (iii) after distillation of the distillate.

Such a pressure controlled environment is provided by enclosing the tobacco extract or the tobacco extract/yeast mixture in an air sealed vessel or chamber. If done prior to fermentation that extract preferably has a moisture content of at least about 5 percent by weight, normally at least about 15 percent by weight and preferably at least about 25 percent by weight. Normally, the moisture content of the extract does not exceed about 90 percent by weight, and frequently does not exceed about 80 percent by weight. Typically, the pressure controlled environment is provided using a pressure vessel or chamber which is capable of withstanding relatively high pressures. Such vessels or chambers (i) provide enclosure or containment of the tobacco composition (i.e. the tobacco extract, tobacco extract/yeast mixture or distillate) such that the volatile flavor and aromatic components of the tobacco extract are not lost or do not otherwise escape during the moderately high temperature treatment step, and (ii) provide for treatment of the tobacco composition at a temperature significantly above about 100° C. Preferred pressure vessels are equipped with an external heating source. Examples of vessels which provide a pressure controlled environment include a Parr Reactor Model No. 4522 and a Parr Reactor Model No. 4552 available from The Parr Instrument Company. Operation of such exemplary vessels will be apparent to the skilled artisan. Typical pressures experienced by the tobacco composition during the process of the present invention range from about 10 psig to about 1,000 psig, normally from about 20 psig to about 500 psig.

The amount of time that the tobacco composition is subjected to the temperature treatment in a pressure controlled environment can vary. Normally, the time period is sufficient to heat an entire tobacco composition at the desired temperature for a period of at least about 10 minutes, preferably at least about 20 minutes. Normally, the time period is less than about 3 hours, preferably less than about 1 hour. However, it is desirable to control the time/temperature profile of tobacco compositions subjected to heat treatment so that each tobacco composition is not subjected to a particularly high temperature for a lengthy period of time. It is highly desirable to employ a pressure vessel design or a vessel equipped with an agitation mechanism such that the particular tobacco composition experiences a relatively uniform temperature throughout the treatment period. In particular, it is highly desirable for the entire tobacco composition to be heated uniformly throughout as much as possible at the maximum temperature to which the tobacco composition is subjected.

Conditions provided during the optional heat treatment most desirably are such that certain components of the tobacco extract undergo Maillard reactions or "browning reactions". Such reactions are reactions between (i) the amino substituents of amino acids, peptides, proteins or other nitrogen-containing compounds, and (ii) the carbonyl group of a sugar in the reducing form or other carboxyl-containing compounds. See, Maillard, *Ana. Chim.*, Vol. 9, pp. 5 and 258 (1916); Hodge, *J. Agric. Food Chem.*, Vol. 1, p. 928 (1953); Nursten, *Food Chem.*, Vol. 6, p. 263 (1981) and Waller et al, *ACS Symp. Ser.* (1983). This reaction is facilitated by adding one or more sugars (e.g., fructose, sucrose, glucose, maltose) and/or one or more amino acids or amino acid analogs (e.g., glutamine, asparagine, proline, alanine, cystine, aspartic acid, phenylalanine, glutamic acid) to the extract, the extract/yeast mixture or the distillate prior to treatment in the pressure vessel. Such reactions result in a significant darkening of the tobacco extract, typically to an extremely dark brown color. Such reactions often result in a moist tobacco composition of increased viscosity, particularly when the mixture is subjected to the treatment over relatively a long period of time. Additionally, flavoring agents (e.g. cocoa, licorice, St. John's bread, spices, herbs, and the like) can be added to the extract.

The collected tobacco-derived components are used in various forms in the manufacture of smoking articles. For example, the isolated flavor and aromatic components can be contacted with tobacco and employed as a form of tobacco in smoking article manufacture. For example, tobacco cut filler, as well as the types of smokable materials described in U.S. Pat. application Ser. No. 276,161, filed Nov. 23, 1988, now U.S. Pat. No. 4,920,990 to Lawrence et. al. can be coated with about 0.001 to about 1 percent by weight of the tobacco-derived components, based on the weight of the particular smokable material. Furthermore, the coated tobacco may be combined with aerosol forming materials, and employed in the manufacture of those smoking articles described in U.S. Pat. Nos. 4,708,151 to Shelar; 4,771,795 to White et al; 4,714,082 to Banerjee et al; 4,756,318 to Clearman et al; and 4,793,365 to Sensabaugh et al; as well as European Patent Publication Nos. 212,234 and 277,519. In addition, the coated tobacco can be incorporated into those smoking articles described in U.S. Pat. Application Ser. No. 414,833 filed Sept. 29, 1989 and European Patent Publication No. 280,990.

The tobacco-derived components can also be contacted with a substrate. Preferred substrates are normally solid materials and are thermally stable at those temperatures experienced during the heat treatment steps of the present invention. Examples of suitable substrate materials include porous carbons, carbon fibers, carbon yarns, high surface area glass beads, aluminas, clays, and the like. Typical substrates are aluminas available as D-2 Sintered Alpha Alumina from W. R. Grace & Co. and carbon yarns available as Kynol Catalogue No. CFY-020Y-3 from American Kynol, Inc. Furthermore, the tobacco-derived components can be contacted with an organic liquid. Examples or organic liquids include polyhydric alcohols (e.g., glycerin and propylene glycol).

The following examples are provided in order to further illustrate various embodiments of the invention but should not be construed as limiting the scope thereof. Unless otherwise noted, all parts and percentages are by weight.

EXAMPLE 1

An aged flue-cured tobacco in cut filler form is extracted in a stainless steel tank at a concentration of about 1 pound of tobacco per gallon of water. The extraction is conducted at ambient temperature (e.g., about 20° C.) while mechanically agitating the mixture over about a 1 hour period. The admixture is centrifuged to remove essentially all suspended solids. The aqueous extract is concentrated in a thin film evaporator to a concentration of about 30 percent dissolved solids. Thin film evaporation from the extract while loss of favorable and aromatic tobacco components is minimized. The concentrated aqueous extract then is sprayed dried by continuously pumping the aqueous solution to an Anhydro Size No. 1 spray dryer. The dried powder is collected at the outlet of the dryer. The inlet temperature of the spray dryer is about 215° C., and the outlet temperature is about 82° C. The spray dried material is a brown, powdery material, and has a moisture content of about 3 percent by weight to about 8 percent by weight.

The spray dried extract is mixed with water. In particular, about 500 g of the extract is mixed with 3000 g of water. The resulting moist extract is contacted with about 1000 g of table sugar (sucrose), a can (3.3 lbs) of Geordie mild malt and a packet (about 5g) of Geordie yeast. The mixture is placed in a 20 liter polyethylene food container and is fermented for 11 days.

The fermented extract/yeast mixture is divided into two parts, arbitrarily designated "Part A" and "Part B". The extract/yeast mixture has about a 10% alcohol content as measured using a commonly available vinometer.

The Part A extract/yeast mixture having an initial weight of 3845.0 g is distilled at a temperature of about 60° C. to 80° C. in a round bottom flask with a heating mantle. The distillate is condensed by a condenser with a spiral inner tube. The condenser is cooled by an ice water bath. The residue in the flask is discarded. The distillate is re-distilled and a total of four distillations are done with the following weight and percent alcohol amounts of distillate collected:

| Distillation Number | Weight Distillate (g) | % Alcohol* |
|---|---|---|
| 1 | 1960.0 | 14 |
| 2 | 980.5 | 22 |
| 3 | 489.9 | 42 |
| 4 | 248.4 | 63 |

*The commercial vinometer reads accurately up to a level of 25% alcohol. For sample that had levels of alcohol greater than 25%, the samples were diluted and read, then adjusted to the values higher than 25%.

The Part B extract/yeast mixture having an initial weight of 1487.0 g is reacted in a Parr Reactor Model No. 4522 equipped with a temperature control unit available as Parr No. 4842-PID from the Parr Instrument Co. The pressure vessel is equipped with a mechanical stirrer. The extract/yeast mixture then is subjected to exposure to a maximum temperature of about 160° C. for about 30 minutes at a pressure of about 30 psig. Then, the extract/yeast mixture is removed from the pressure vessel. The extract/yeast mixture exhibits an extremely dark brown color and a pleasant malty, fruity, tobacco-like aroma.

The extract/yeast mixture is then distilled in the same manner as the Part A mixture. A total of four distillations are done with the following weight and percent alcohol amounts of distillate collected:

| Distillation Number | Weight Distillate (g) | % Alcohol |
|---|---|---|
| 1 | 762.9 | 13 |
| 2 | 385.0 | 23 |
| 3 | 195.2 | 38 |
| 4 | 118.0 | 50 |

The distillates of Part A and Part B exhibited a pleasant fermented roasted, nutty aroma. The aroma became stronger or more intense over time as the distillate is concentrated and the alcohol content increased.

EXAMPLE 2

A spray dried extract is prepared as in Example 1. About 1000 g of the extract is mixed with 10 liters of water. The moist extract is contacted with about 1000 g of table sugar and a can (3.3 lbs) of Laaglander Irish Ale yeast. The mixture is placed in a 20 liter polyethylene food container and is fermented for 11 days.

The fermented extract/yeast mixture is distilled as in Example 1 with Part A having an initial weight of 3525.0 g and Part B having an initial weight of 1241.1 g. A total of four distillations of both Part A and Part B mixtures are done with the following weight and percent alcohol amounts of distillate collected:

| | Part A | |
|---|---|---|
| Distillation Number | Weight Distillate (g) | % Alcohol |
| 1 | 1744 | 14 |
| 2 | 849 | 23 |
| 3 | 682 | 32 |
| 4 | 371 | 54 |

The distillates of Part A has a sweet tobacco, malty aroma.

| | Part B | |
|---|---|---|
| 1 | 620.4 | 20 |
| 2 | 335.0 | 31 |
| 3 | 170.5 | 44 |
| 4 | 91.0 | 60 |

The distillates of Part B exhibit a meady tobacco nutty roasted aroma.

EXAMPLE 3

A spray dried extract is prepared as in Example 1. About 2000 g of the extract is mixed with 10 liters of water. The moist extract is contacted with 2000 g of table sugar and a packet (about 7 g) of Ale Beer yeast. The mixture is fermented in a 20 liter polyethylene food container for 10 days.

The fermented extract/yeast mixture is distilled as in Example 1 with Part A having an initial weight of 1910.0 g. No Part B is divided out. A total of four distillations are done with the following weight percent alcohol amounts of distillate collected.

| | Part A | |
|---|---|---|
| Distillation Number | Weight Distillate (g) | % Alcohol |
| 1 | 978 g | 15 |
| 2 | 493 g | 24 |
| 3 | 250 g | 46 |
| 4 | 130 g | 60 |

The distillates have a musty, sour, earthy aroma

EXAMPLE 4

A spray dried extract is prepared as in Example 1. About 2000 g of the extract is mixed with 10 liters of water. The moist extract is contacted with 2000 g of table sugar and a packet (about 5 g) of Montrachet yeast. The mixture is fermented in a 20 liter polyethylene food container for 10 days.

The fermented extract/yeast mixture is distilled as in Example 1 with Part A having a initial weight of 1913.0 g. No Part B is divided out. A total of four distillations are done with the following weight percent alcohol amounts of distillate collected.

| | Part A | |
|---|---|---|
| Distillation Number | Weight Distillate (g) | % Alcohol |
| 1 | 954 g | 14 |
| 2 | 476 g | 23 |
| 3 | 242 g | 42 |
| 4 | 140 g | 63 |

The distillates have a fermented wine aroma.

That which we claim is:

1. A process for altering the chemical nature of a tobacco extract thereby providing tobacco-derived components of that tobacco extract, the process comprising:
   (a) extracting tobacco material with an extraction solvent to provide a tobacco extract separate from tobacco residue insoluble in the extraction solvent;
   (b) fermenting the tobacco extract within a fermentation bath to provide a fermented tobacco extract mixture;
   (c) distilling the fermented tobacco extract mixture to provide a distillate including tobacco-derived components of the tobacco extract and
   (d) collecting, the distillate which includes distilled tobacco derived components of the tobacco extract.

2. The process of claim 1 whereby the extraction solvent is a liquid having an aqueous character.

3. The process of claim 1 whereby the fermentation bath includes at least one strain of yeast.

4. The process of claim 3 whereby the fermentation bath is a liquid having an aqueous character.

5. The process of claim 3 whereby the yeast is selected from the group consisting of strains of Candida, Kluyveromyces and Saccharomyces.

6. The process of claim 1 whereby step (c) is performed at a temperature between about 75° C. to about 85° C. and at atmospheric pressure.

7. The process of claim 6 further including distilling the distillate at a temperature between about 75° C. to about 85° C. and at atmospheric pressure until the distillate has an alcohol content of at least about 50 percent by weight.

8. The process of claim 1 further comprising contacting the extract of step (a) with at least one sugar and/or at least one amino acid.

9. The process of claim 1 further comprising subjecting the distillate provided in step (c) to heat treatment in a pressure controlled environment.

10. The process of claim 9 further comprising contacting the distillate of step (c) with at least one sugar and/or at least one amino acid prior to the step of heat treatment.

11. The process of claim 1 further comprising the step of subjecting the tobacco extract provided in step (c) to heat treatment in a pressure controlled environment prior to the step (b).

12. The process of claim 9 or 11 including providing the tobacco extract such that the moisture content prior to heat treatment thereof is at least about 25 percent by weight.

13. The process of claim 11 further comprising contacting the extract mixture of step (b) with at least one amino acid and at least one sugar prior to heat treatment.

14. The process of claim 9 or 11 whereby the tobacco extract is subjected to heat treatment at a pressure of about 10 psig to 1,000 psig a temperature of at least about 180° C.

15. The process of claim 1, 9 or 11 whereby the tobacco is fermented over a period of at least about two days.

16. The process of claim 1, 9 or 11 whereby the fermented tobacco extract is fermented to provide a fermented tobacco extract mixture having an alcohol content of at least about 15 percent by weight.

17. A process for altering the chemical nature of a tobacco extract thereby providing tobacco-derived components of that tobacco extract, the process comprising:

(a) extracting tobacco material with an extraction solvent to provide a tobacco extract;
(b) fermenting the tobacco extract within a fermentation bath to provide a fermented tobacco extract mixture;
(c) subjecting the fermented tobacco extract mixture to heat treatment in a pressure controlled environment to provide a heat treated fermented tobacco extract; and
(d) distilling the heat treated fermented tobacco extract mixture to provide a distillate including tobacco-derived components of the tobacco extract.

18. The process of claim 17 whereby the extraction solvent is a liquid having an aqueous character.

19. The process of claim 17 whereby the fermentation bath includes at least one strain of yeast.

20. The process of claim 19 whereby the fermentation bath is a liquid having an aqueous character.

21. The process of claim 19 whereby the yeast is selected from the group consisting of strains of Candida, Kluyveromyces and Saccharomyces.

22. The process of claim 17 whereby step (c) is performed at a temperature between about 75° C. to about 85° C. and at atmospheric pressure.

23. The process of claim 22 further including of distilling the distillate at a temperature between about 75° C. to about 85° C. and at atmospheric pressure until the distillate has an alcohol content of at least about 50 percent by weight.

24. The process of claim 17 including providing the tobacco extract such that the moisture content thereof prior to heat treatment is at least about 25 percent by weight.

25. The process of claim 17 further comprising contacting the fermented extract mixture of step (b) with at least one amino acid and/or at least one sugar prior to the step (c).

26. The process of claim 17 whereby the fermented tobacco extract is subjected to heat treatment in step (c) at a pressure of about 10 psig to 1,000 psig and at a temperature of at least about 180° C.

27. The process of claim 17 whereby the tobacco extract is fermented over a period of at least about two days.

28. The process of claim 17 whereby the fermented tobacco extract is fermented to provide a fermented tobacco extract mixture having an alcohol content of at least about 15 percent by weight.

29. A process for altering the chemical nature of a tobacco extract thereby providing tobacco-derived components of that tobacco extract, the process comprising:

(a) extracting tobacco material with an extraction solvent to provide a tobacco extract;
(b) contacting the tobacco extract with at least one sugar and/or at least one amino acid;
(c) fermenting the tobacco extract within a fermentation bath to provide a fermented tobacco extract mixture; and
(d) distilling the fermented tobacco extract mixture to provide a distillate including tobacco-derived components of the tobacco extract.

30. The process of claim 29 whereby the extraction solvent is a liquid having an aqueous character.

31. The process of claim 29 whereby the fermentation bath includes at least one strain of yeast.

32. The process of claim 31 whereby the fermentation bath is a liquid having an aqueous character.

33. The process of claim 31 whereby the yeast is selected from the group consisting of strains of Candida,, Kluyveromyces and Saccharomyces.

34. The process of claim 29 whereby step (d) is performed at a temperature between about 75° C. to about 85° C. and at atmospheric pressure.

35. The process of claim 34 further including distilling the distillate at a temperature between about 75° C. to about 85° C. and at atmospheric pressure until the distillate has an alcohol content of at least about 50 percent by weight.

36. The process of claim 29 further comprising subjecting the distillate provided in step (d) to heat treatment in a pressure controlled environment.

37. The process of claim 36 including providing the tobacco extract such that the moisture content prior to heat treatment thereof is at least about 25 percent by weight.

38. The process of claim 36 whereby the tobacco extract is subjected to heat treatment at a pressure of about 10 psig to 1,000 psig a temperature of at least about 180° C.

39. The process of claim 29 or 36 whereby the tobacco is fermented over a period of at least about two days.

40. The process of claim 29 or 36 whereby the fermented tobacco extract is fermented to provide a fermented tobacco extract mixture having an alcohol content of at least about 15 percent by weight.

* * * * *